US012569776B1

(12) United States Patent
Lin

(10) Patent No.: US 12,569,776 B1
(45) Date of Patent: Mar. 10, 2026

(54) TOY AIRCRAFT

(71) Applicant: Shantou Jianzhi Xingkong Technology Co., Ltd., Shantou (CN)

(72) Inventor: Guoheng Lin, Shantou (CN)

(73) Assignee: Shantou Jianzhi Xingkong Technology Co., Ltd., Shantou (CN)

( * ) Notice: Subject to any disclaimer, the term of this patent is extended or adjusted under 35 U.S.C. 154(b) by 0 days.

(21) Appl. No.: 19/279,890

(22) Filed: Jul. 24, 2025

(30) Foreign Application Priority Data

Apr. 9, 2025 (CN) ..... 202520651775.9

(51) Int. Cl.
*A63H 27/00* (2006.01)

(52) U.S. Cl.
CPC ..... *A63H 27/005* (2013.01)

(58) Field of Classification Search
CPC ..... A63H 27/005; A63H 27/12
See application file for complete search history.

(56) References Cited

U.S. PATENT DOCUMENTS

| | | | | |
|---|---|---|---|---|
| 5,071,383 | A * | 12/1991 | Kinoshita | B64U 10/13 244/30 |
| 7,712,701 | B1 * | 5/2010 | Ehrmantraut | B64U 50/19 244/17.23 |
| 7,789,341 | B2 * | 9/2010 | Arlton | B64U 30/21 244/6 |
| 8,469,307 | B2 * | 6/2013 | Arlton | B64U 50/19 244/17.23 |
| 8,888,551 | B2 * | 11/2014 | Xu | A63H 27/12 244/17.23 |
| 9,216,363 | B2 * | 12/2015 | Sullivan | A63H 27/00 |
| 9,981,744 | B2 * | 5/2018 | Choo | B64C 29/0025 |
| 10,106,252 | B1 * | 10/2018 | Tearne | B64U 50/19 |
| 10,150,567 | B2 * | 12/2018 | Lauder | B64D 31/18 |
| 10,343,771 | B1 * | 7/2019 | Kaiser | B64U 40/10 |
| 10,370,089 | B2 * | 8/2019 | Gamble | B64C 27/52 |
| 10,407,169 | B2 * | 9/2019 | Groninga | B64C 29/02 |
| 11,292,595 | B2 * | 4/2022 | Meringer | B64U 50/19 |
| 2006/0121819 | A1 * | 6/2006 | Isawa | A63H 27/12 446/37 |
| 2018/0104610 | A1 * | 4/2018 | Todokoro | A63H 27/12 |
| 2020/0061480 | A1 * | 2/2020 | Rehkemper | A63H 30/04 |

FOREIGN PATENT DOCUMENTS

| | | | | |
|---|---|---|---|---|
| CN | 104043251 | A | 9/2014 | |
| CN | 106215430 | A | 12/2016 | |
| CN | 219558703 | U | 8/2023 | |
| GB | 2503273 | A * | 12/2013 | A63H 27/12 |

* cited by examiner

*Primary Examiner* — Eugene L Kim
*Assistant Examiner* — Alyssa M Hylinski
(74) *Attorney, Agent, or Firm* — Nitin Kaushik

(57) ABSTRACT

This disclosure relates to a toy aircraft. The toy aircraft includes a main body, a driving assembly, a lifting assembly, and a connecting rod. The driving assembly includes a battery box, a motor seat, a motor set, and a gear set, the battery box and the motor seat are both arranged in the main body, the motor set is arranged on the motor seat, the gear set is rotatably connected to the motor seat, the battery box is electrically connected to the motor set, an output end of the motor set is in meshing connection with the gear set, the connecting rod extends into the main body and is connected to the motor seat, and the gear set is sleeved on the connecting rod; and the lifting assembly includes a first rotating blade and a first rotating shaft.

7 Claims, 12 Drawing Sheets

TOY AIRCRAFT

CROSS-REFERENCE TO RELATED APPLICATIONS

The application claims priority to Chinese patent application No. 2025206517759, filed on Apr. 9, 2025, the entire contents of which are incorporated herein by reference.

TECHNICAL FIELD

This disclosure belongs to the technical field of flying toys, and in particular, to a toy aircraft.

BACKGROUND

At this stage, children's toys are becoming more and more diversified, and all kinds of flying machines can be manipulated by children to fly up and down, as well as move horizontally. However, the existing aircrafts are mostly airplane-shaped, and to use them for fun, they must be manipulated in an open field. If the site is not large enough, on the one hand, it is difficult for the aircraft to fly, and on the other hand, the aircraft is prone to being damaged due to collision. Although airplane-type aircraft can be used by children for fun, the uncertain flight direction and flight speed of the aircraft can pose a danger to personal safety of others to some extent.

Therefore, some people have developed an aircraft for indoor entertainment. For example, after being lifted by a hand below the aircraft, the aircraft can fly upwards and continuously fly up and down. However, this aircraft also has a risk of uncertain direction and difficulty in control. Although the purpose of indoor entertainment is achieved, personal safety is still threatened.

SUMMARY

To solve the above technical problem, this disclosure provides a toy aircraft, double-layer rotating blades are arranged to rotate and fly in an opposite direction, so that the effect of stabilizing vertical flight is achieved. Meanwhile, a traveling rotating blade arranged vertically is used for transverse flight movement, and the aircraft is stable in flight state and easy to control.

To achieve the foregoing objective, this disclosure adopts the following technical solution:

a toy aircraft, including a main body, a driving assembly, a lifting assembly, and a connecting rod; where the driving assembly includes a battery box, a motor seat, a motor set, and a gear set, the battery box and the motor seat are both arranged in the main body, the motor set is arranged on the motor seat, the gear set is rotatably connected to the motor seat, the battery box is electrically connected to the motor set, an output end of the motor set is in meshing connection with the gear set, the connecting rod extends into the main body and is connected to the motor seat, and the gear set is sleeved on the connecting rod; and the motor set includes an outer motor and an inner motor, the gear set includes an outer gear and an inner gear, the outer gear and the inner gear are coaxial and parallel to each other and are sleeved on the connecting rod through a bearing, an output end of the outer motor meshes with the outer gear, and an output end of the inner motor meshes with the inner gear.

The lifting assembly includes a first rotating blade, a first rotating shaft, a first rotating cylinder, a second rotating blade, a second rotating shaft, a second rotating cylinder, a balance shaft, a balance rod, and a stabilizing rod. The first rotating shaft is sleeved on the connecting rod and is connected to the gear set, and the first rotating blade is rotatably connected to an outer side wall of the first rotating shaft; the first rotating cylinder is sleeved on the connecting rod and is connected to the motor seat through a bearing, an upper end of the first rotating cylinder is embedded and fixed in the first rotating shaft, and a lower end of the first rotating cylinder is embedded and fixed in the outer gear; the second rotating shaft is sleeved on the connecting rod, the second rotating blade is rotatably connected to an outer side wall of the second rotating shaft, the second rotating cylinder is sleeved on the connecting rod and located in the first rotating cylinder, the second rotating cylinder is connected to the first rotating shaft and the outer gear through a bearing, respectively, an upper end of the second rotating cylinder is embedded and fixed in the second rotating shaft, and a lower end of the second rotating cylinder is embedded and fixed in the inner gear; the balance shaft is detachably connected to the second rotating shaft, the balance rod is rotatably connected to an outer side wall of the balance shaft, and a counterweight block is arranged at a tail end of the balance rod; and the stabilizing rod is connected to the second rotating shaft and the balance shaft, respectively.

The toy aircraft further includes a traveling assembly, where the traveling assembly includes a fixed seat, a traveling motor, and a traveling rotating blade. The fixed seat is arranged at a top end of the connecting rod, a transverse air duct is arranged in the fixed seat, the traveling motor is arranged in the fixed seat, an output end of the traveling motor is connected to the traveling rotating blade, the traveling motor is electrically connected to the battery box, and the traveling rotating blade is vertically arranged in the transverse air duct.

According to the toy aircraft adopting the structure, the battery box in the main body supplies power to the motor set on the motor seat, and the motor set is detachably mounted on the motor seat. Preferably, the motor seat is provided with a mounting seat for mounting the outer motor and the inner motor. Both the outer motor and the inner motor are arranged vertically, and the outer gear and the inner gear are transversely arranged in parallel. The inner gear is located below the outer gear and is rotatably connected to the bottom of the motor seat, and the output ends of the outer motor and the inner motor are in meshing connection with the outer gear and the inner gear, respectively.

To drive the first rotating blade and the second rotating blade to rotate in different directions in a starting process of the motor set, a connecting column is vertically arranged at the bottom of the motor seat and extends upwards vertically, the first rotating cylinder is sleeved on the connecting column and is connected to the motor seat through a bearing, the upper end of the first rotating cylinder is embedded and fixed in the first rotating shaft, and the lower end of the first rotating cylinder is embedded and fixed in the outer gear. Therefore, in a process of starting the outer motor, the outer gear meshed with the outer motor is driven to rotate, so that the first rotating shaft is driven to rotate, the first rotating blade rotatably connected to the outer side wall of the first rotating shaft rotates, and at least two groups of first rotating blades with the first rotating shaft as a symmetric center rotate under the action of centrifugal force; and the second rotating cylinder is also sleeved on the connecting column and located in the first rotating cylinder, the second rotating cylinder is connected to the first rotating shaft and the outer gear through a bearing, respectively, the upper end of the second rotating cylinder is embedded and fixed in the second rotating shaft, and the lower end of the second rotating cylinder is embedded and fixed in the inner gear. Therefore, when the inner motor is started and a rotation direction opposite to the outer motor is kept, the inner gear meshed with the inner motor is driven to rotate, so that the second rotating shaft is driven to rotate, the second rotating blade rotatably connected to the outer side wall of the second rotating shaft rotates, at least two groups of second rotating blades with the second rotating shaft as a symmetric center rotate reversely under the action of centrifugal force, the effect of simultaneous reverse rotation of the double-layer rotating blades is achieved, the reverse torsion force caused by the double-layer rotating blades is counteracted, and stable up-down flight is achieved.

The lift-off effect caused by simple reverse rotation of the double-layer rotating blades is still unstable, and the reason lies in that the air under synchronous rotation is pressurized and turbulent, which causes the aircraft to swing left and right, and the flight state is unstable. Therefore, through at least two groups of balance rods which are mounted on the second rotating shaft and are symmetrical to each other, the balance rods are synchronously driven to rotate in the rotating process of the second rotating blade, and the counterweight block at the end portion of the balance rod can effectively provide stronger centrifugal force, so that left-right transverse swing force caused by turbulence is counteracted, and stable up-down flight of the aircraft is ensured. The stabilizing rod is arranged to fix the connection between the second rotating shaft and the balance shaft.

Since the lift-off effect of the double-layer rotating blades moves up and down, horizontal transverse movement cannot be achieved without external force. Thus, the fixed seat is arranged at an upper end of the connecting rod, the traveling rotating blade is vertically arranged on the transverse air duct in the fixed seat, and the traveling rotating blade is driven by the traveling motor, and therefore, when the aircraft is in a hovering state, the aircraft can be assisted in transverse displacement by starting the traveling rotating blade, thereby achieving the flight effect in each of the up-down, left-right, front-back directions.

Further, the main body further includes a first surrounding wall and a second surrounding wall. The first surrounding wall is sleeved on and detachably connected to the first rotating shaft, the second surrounding wall is sleeved on and detachably connected to the second rotating shaft, the first surrounding wall, the second surrounding wall, and the main body are coaxial up and down and form a continuous cylindrical shell structure, and an outer portion of the fixed seat is of a cone structure folded upwards.

Further, the toy aircraft further includes a spraying assembly, where the spraying assembly includes a water tank and an atomizer. The water tank is arranged in the main body and located at the bottom of the main body, a through hole for mounting the atomizer is formed in a lower end surface of the water tank, and the bottom of the main body is provided with a plurality of supporting legs distributed circumferentially.

Compared with the prior art, this disclosure has the following advantages: the outer motor and the inner motor are mounted and the outer gear and the inner gear are driven, respectively, so that the effect of simultaneous reverse rotation of the double-layer rotating blades is achieved, the reverse torsion force caused by the double-layer rotating blades is counteracted, and stable up-down flight is achieved. To counteract the left-right transverse swing force caused by turbulence, and ensure stable up-down flight of the aircraft, a balance rod synchronously rotating with the second rotating blade is arranged, so that more stable up-down flight is achieved, meanwhile, transverse displacement of the aircraft is achieved through arrangement of the traveling rotating blade, and finally the flight effect in each of the up-down, left-right, front-back directions is achieved.

BRIEF DESCRIPTION OF THE DRAWINGS

To describe the technical solutions in the embodiments of this disclosure or in the prior art more clearly, the following briefly describes the accompanying drawings required for describing the embodiments or the prior art. Apparently, the accompanying drawings in the following description show merely some embodiments of this disclosure, and a person of ordinary skill in the art may derive other drawings from these accompanying drawings without creative efforts.

Figure 1:
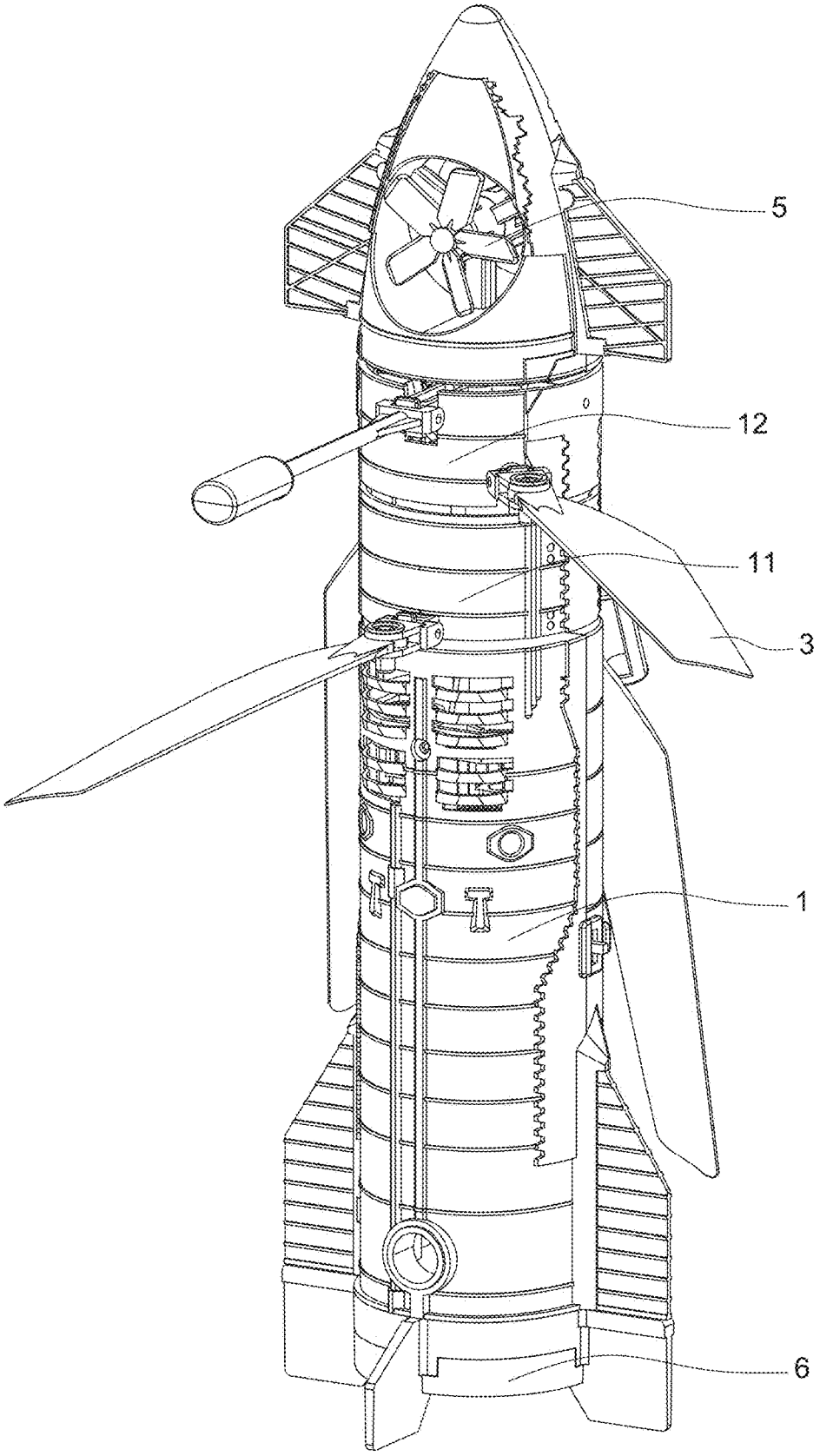
FIG. 1 is a perspective view of this disclosure.

In the drawings: 1. main body; 11. first surrounding wall; 12. second surrounding wall; 13. supporting leg; 2. driving assembly; 21. battery box; 22. motor seat; 23. motor set; 231. outer motor; 232. inner motor; 24. gear set; 241. outer gear; 242. inner gear; 3. lifting assembly; 31. first rotating blade; 32. first rotating shaft; 33. first rotating cylinder; 34. second rotating blade; 35. second rotating shaft; 36. second rotating cylinder; 37. balance shaft; 38. balance rod; 381. counterweight block; 39. stabilizing rod; 4. connecting rod; 5. traveling assembly; 51. fixed seat; 52. traveling motor; 53. traveling rotating blade; 54. transverse air duct; 6. spraying assembly; 61. water tank; 62. atomizer; 7. bearing.

DETAILED DESCRIPTION OF THE EMBODIMENTS

To make the purpose, technical solutions, and advantages of this disclosure clearer, the following clearly and completely describes the technical solutions of this disclosure. Apparently, the embodiments described are only a part rather than all of the embodiments of this disclosure. Based on the embodiments in this disclosure, all other embodiments obtained by those of ordinary skill in the art without making creative efforts shall fall within the protection scope of this disclosure.

The specific implementations of this disclosure are described below with reference to the accompanying drawings.

Figure 2:
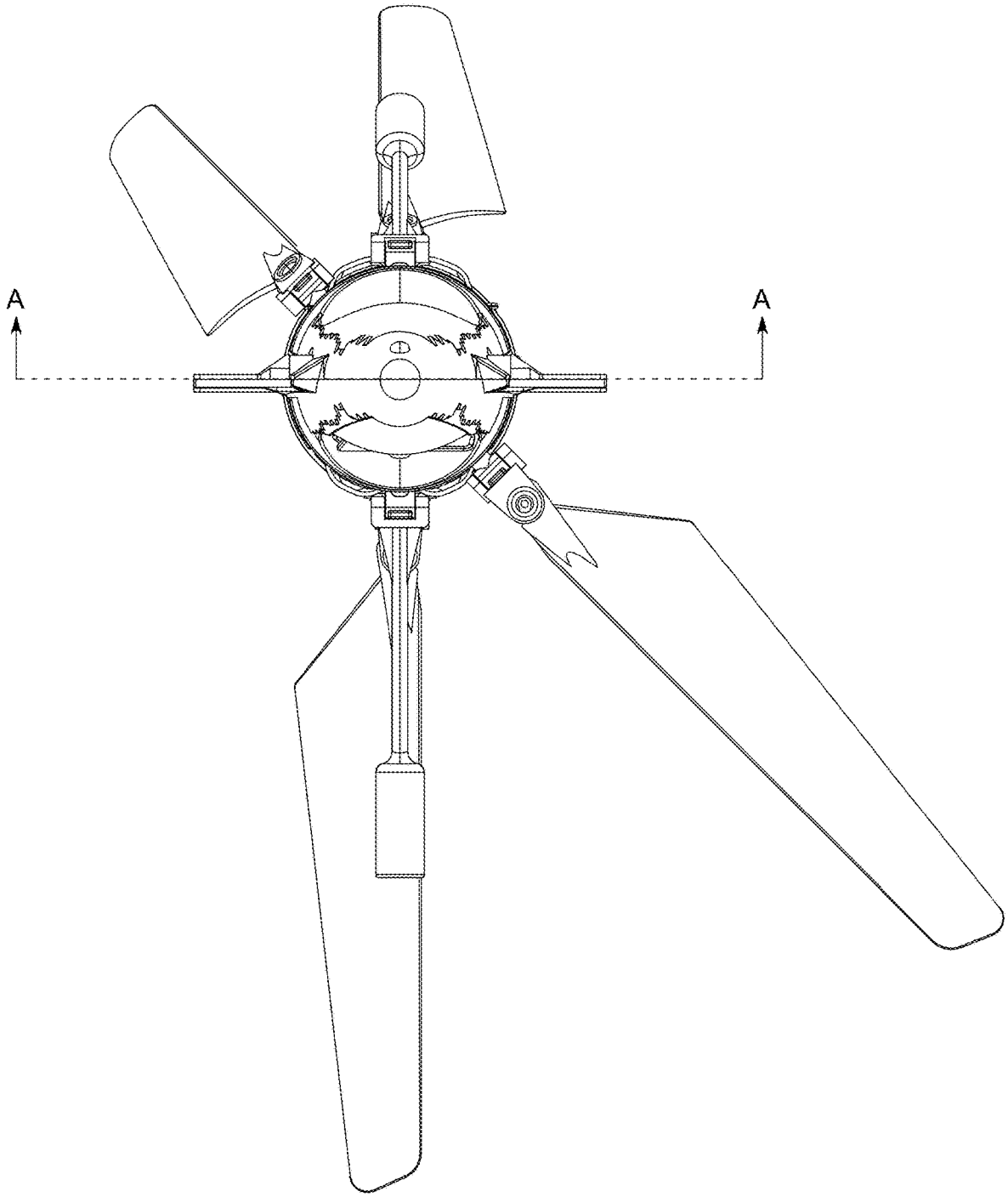
FIG. 2 is a top view of this disclosure.
Figure 3:
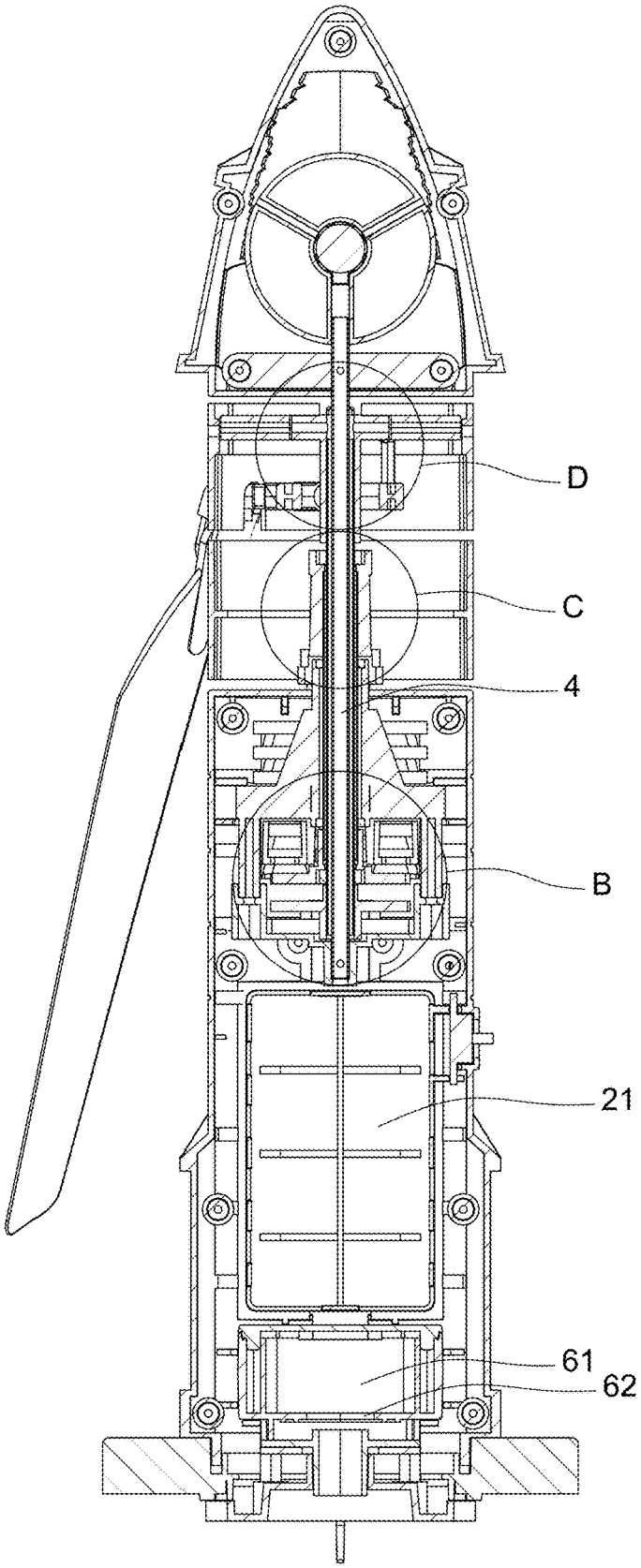
FIG. 3 is an A-A sectional view of FIG. 2 according to this disclosure.
Figure 4:
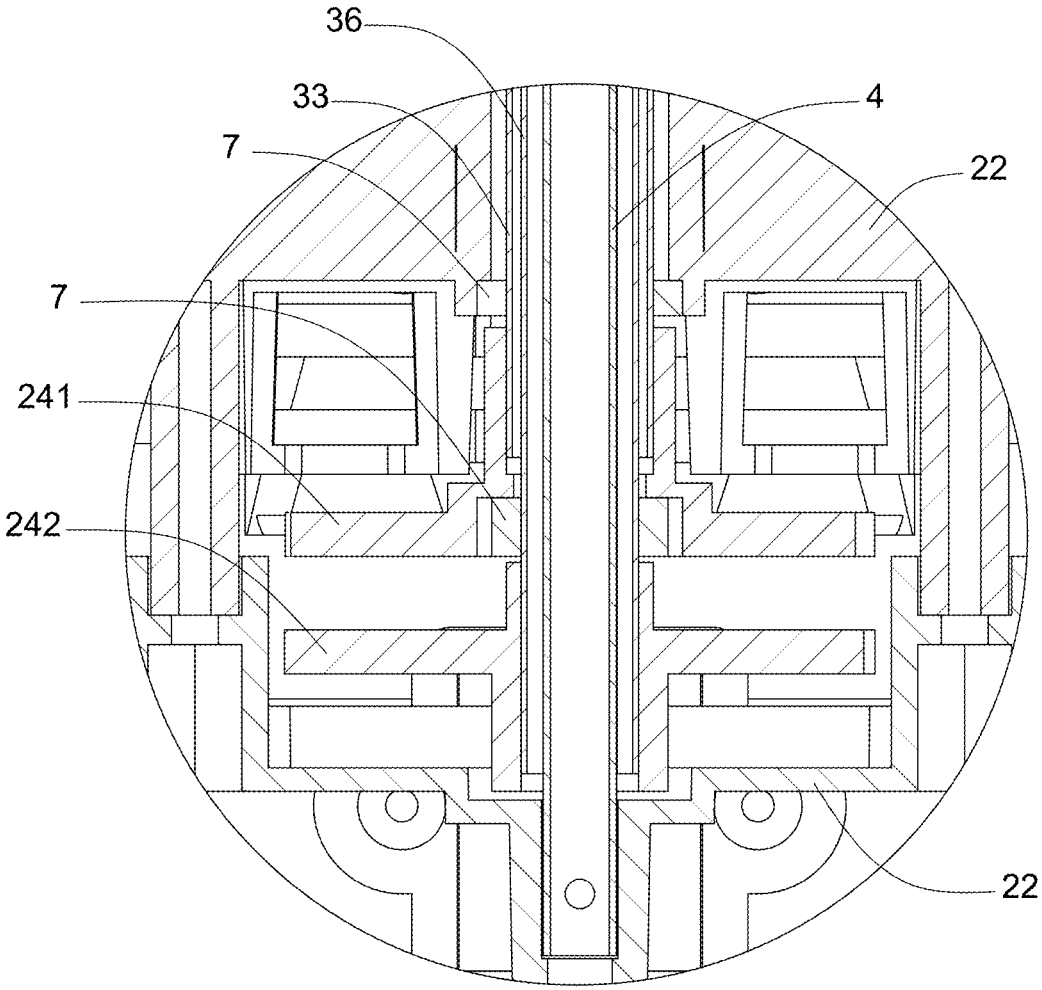
FIG. 4 is a partial enlarged view of a position B in FIG. 3 according to this disclosure.
Figure 5:
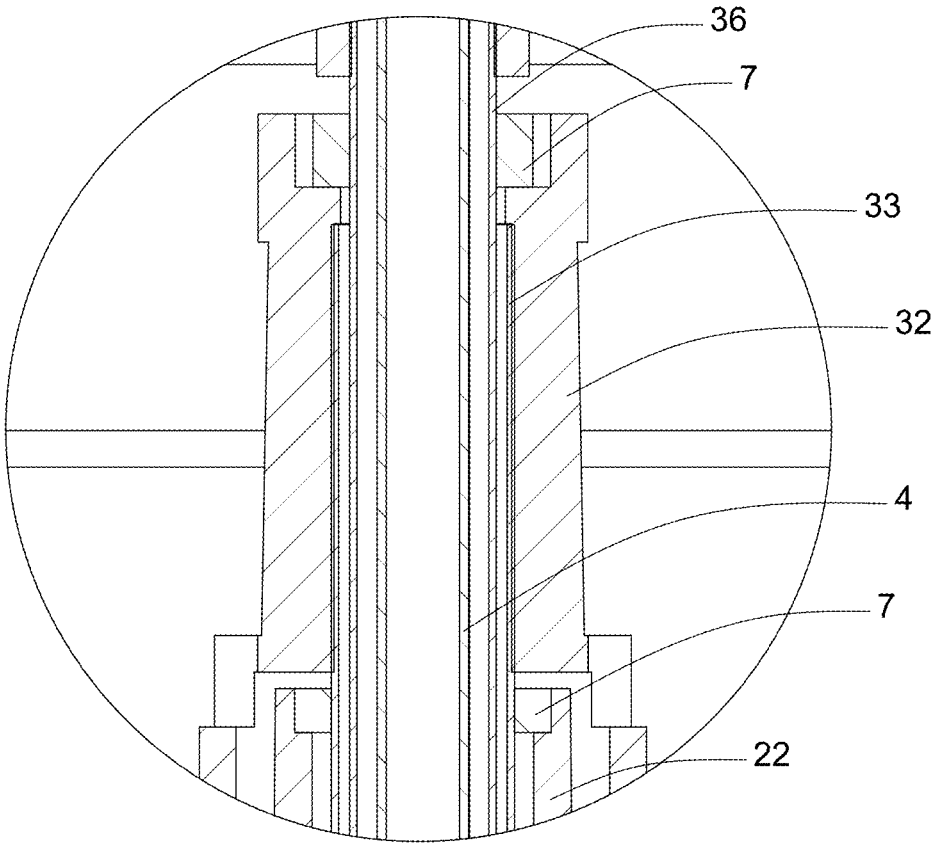
FIG. 5 is a partial enlarged view of a position C in FIG. 3 according to this disclosure.
Figure 6:
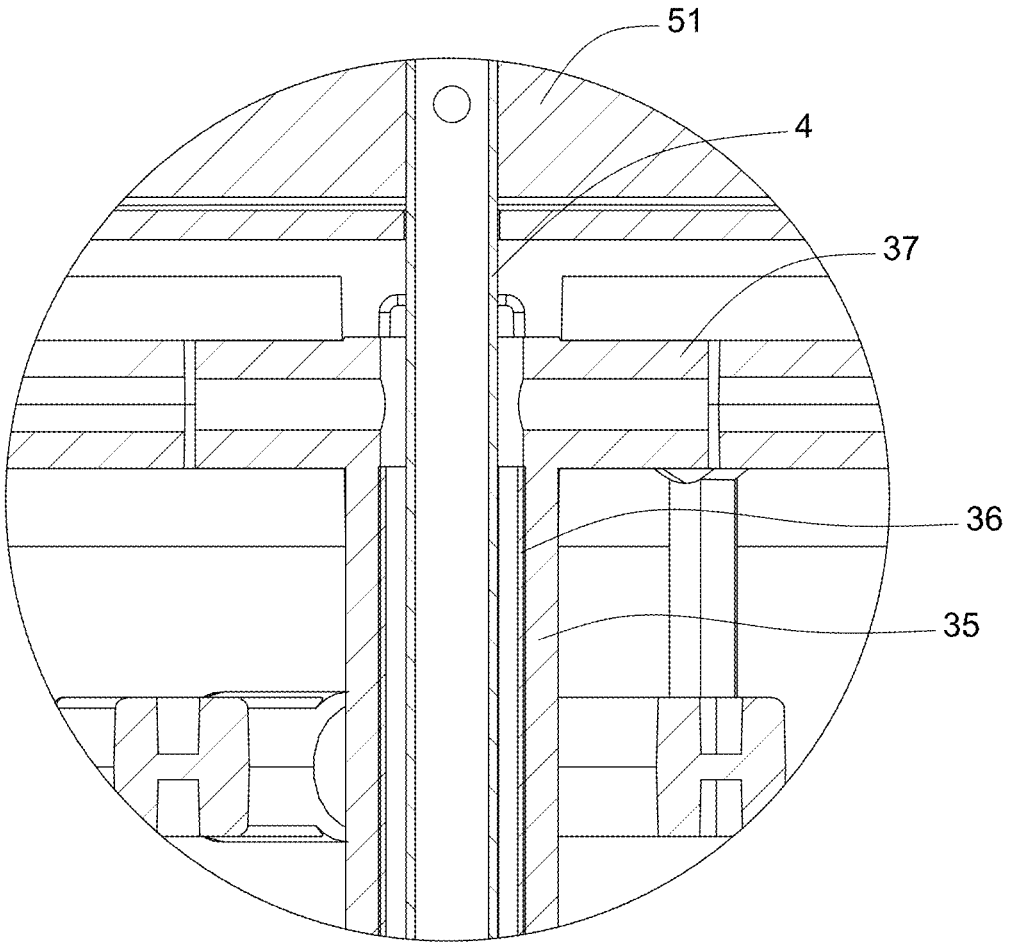
FIG. 6 is a partial enlarged view of a position D in FIG. 3 according to this disclosure.
Figure 7:
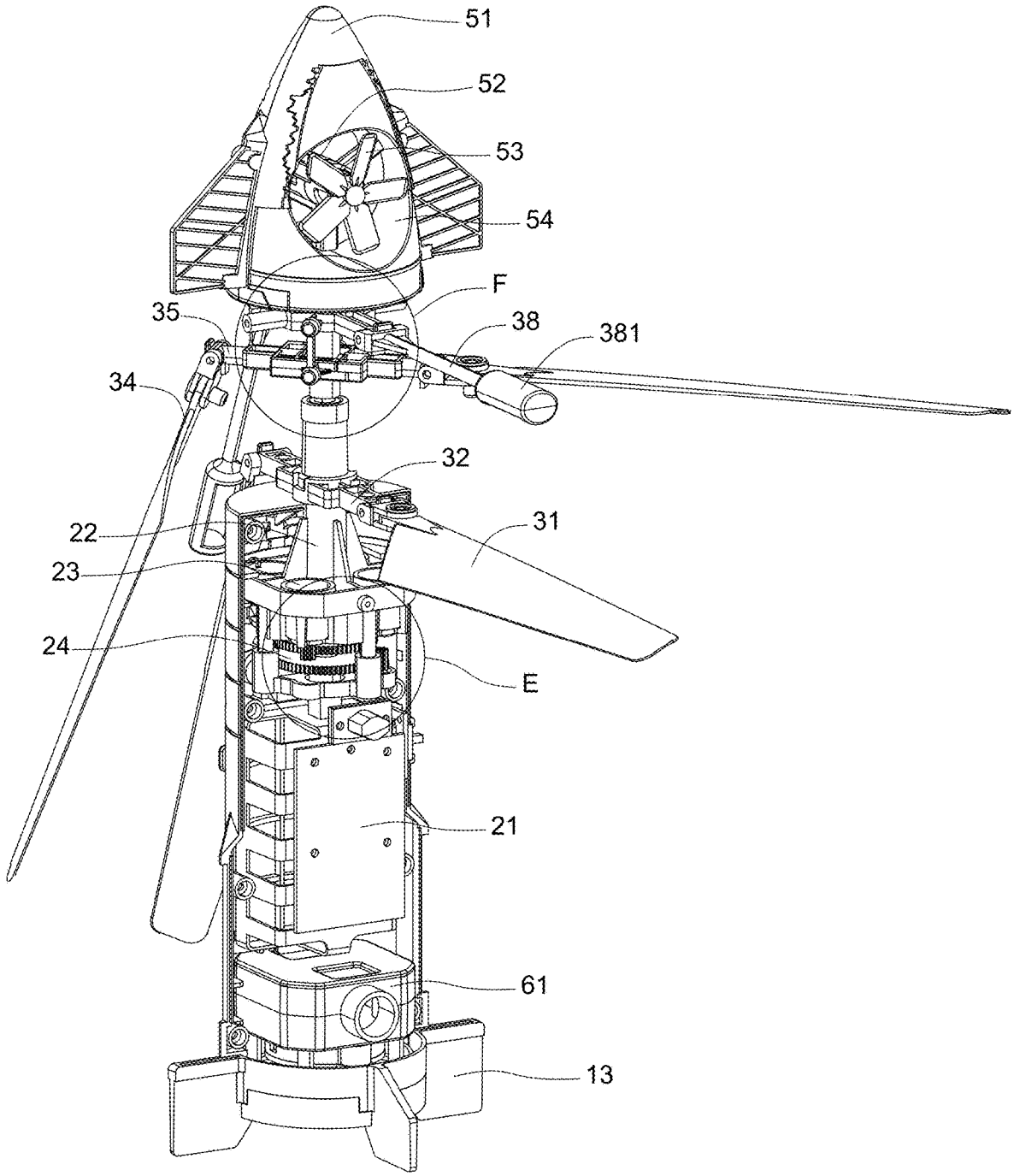
FIG. 7 is a perspective view after a first surrounding wall, a second surrounding wall and part of a main body are hidden according to this disclosure.
Figure 8:
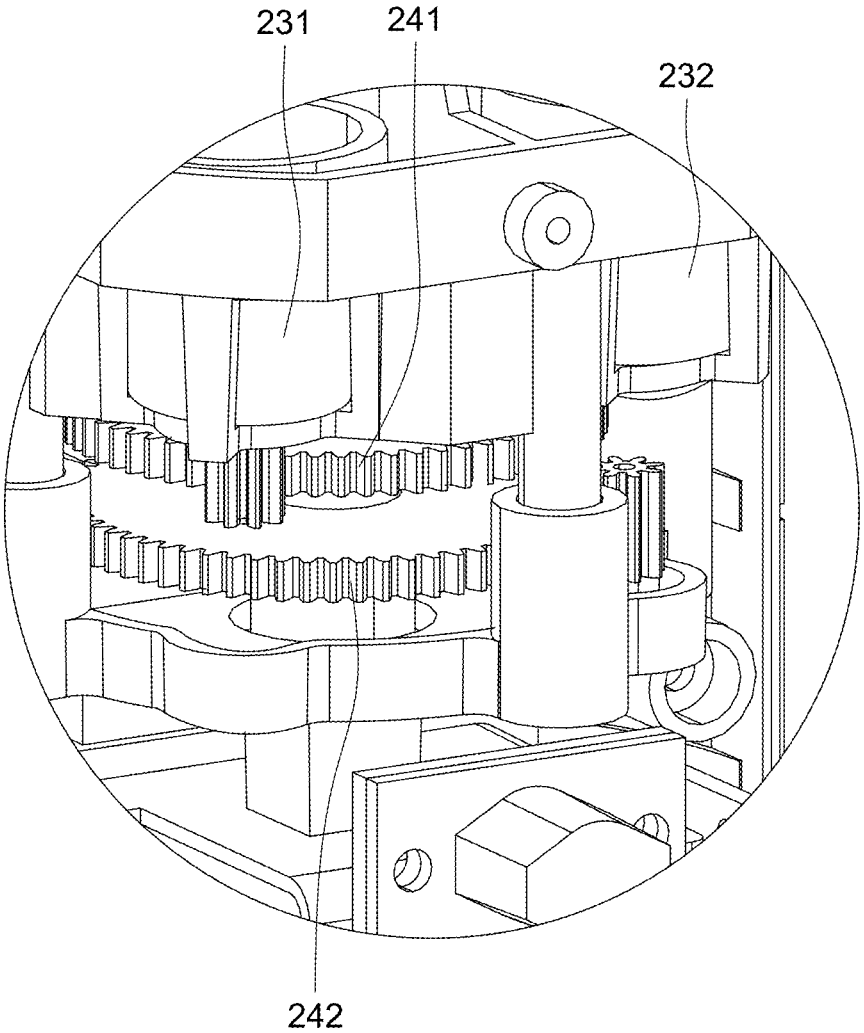
FIG. 8 is a partial enlarged view of a position E in FIG. 7 according to this disclosure.
Figure 9:
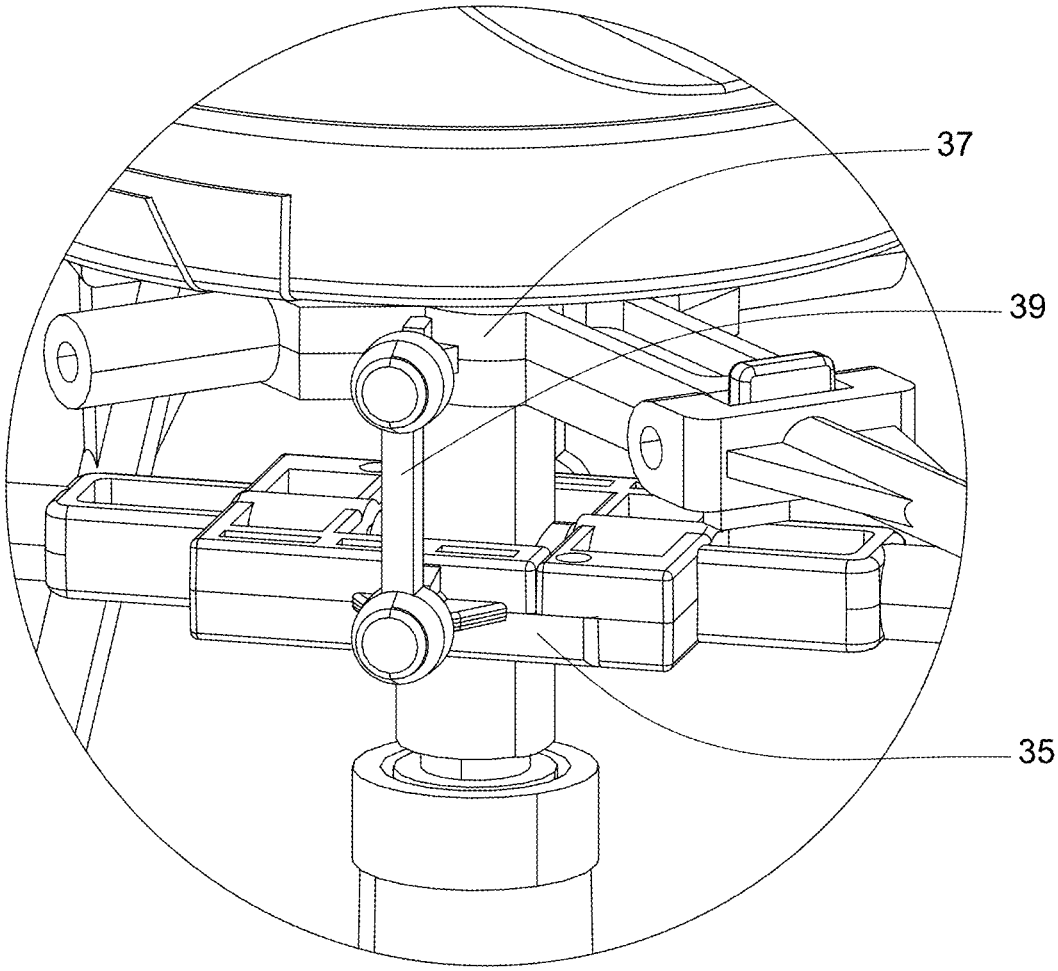
FIG. 9 is a partial enlarged view of a position F in FIG. 7 according to this disclosure.
Figure 10:
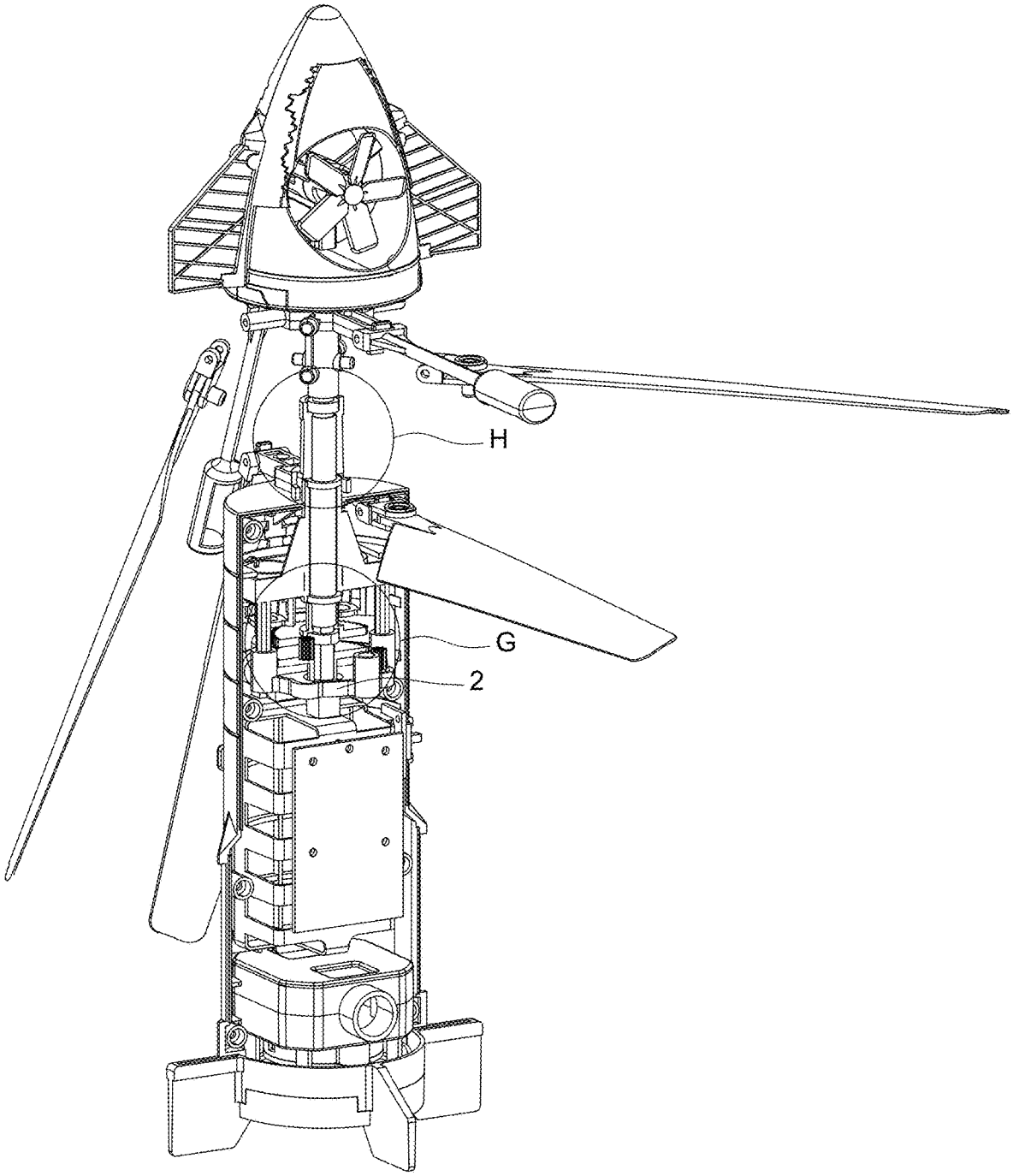
FIG. 10 is a partial sectional perspective view after a first surrounding wall, a second surrounding wall and part of a main body are hidden according to this disclosure.
Figure 11:
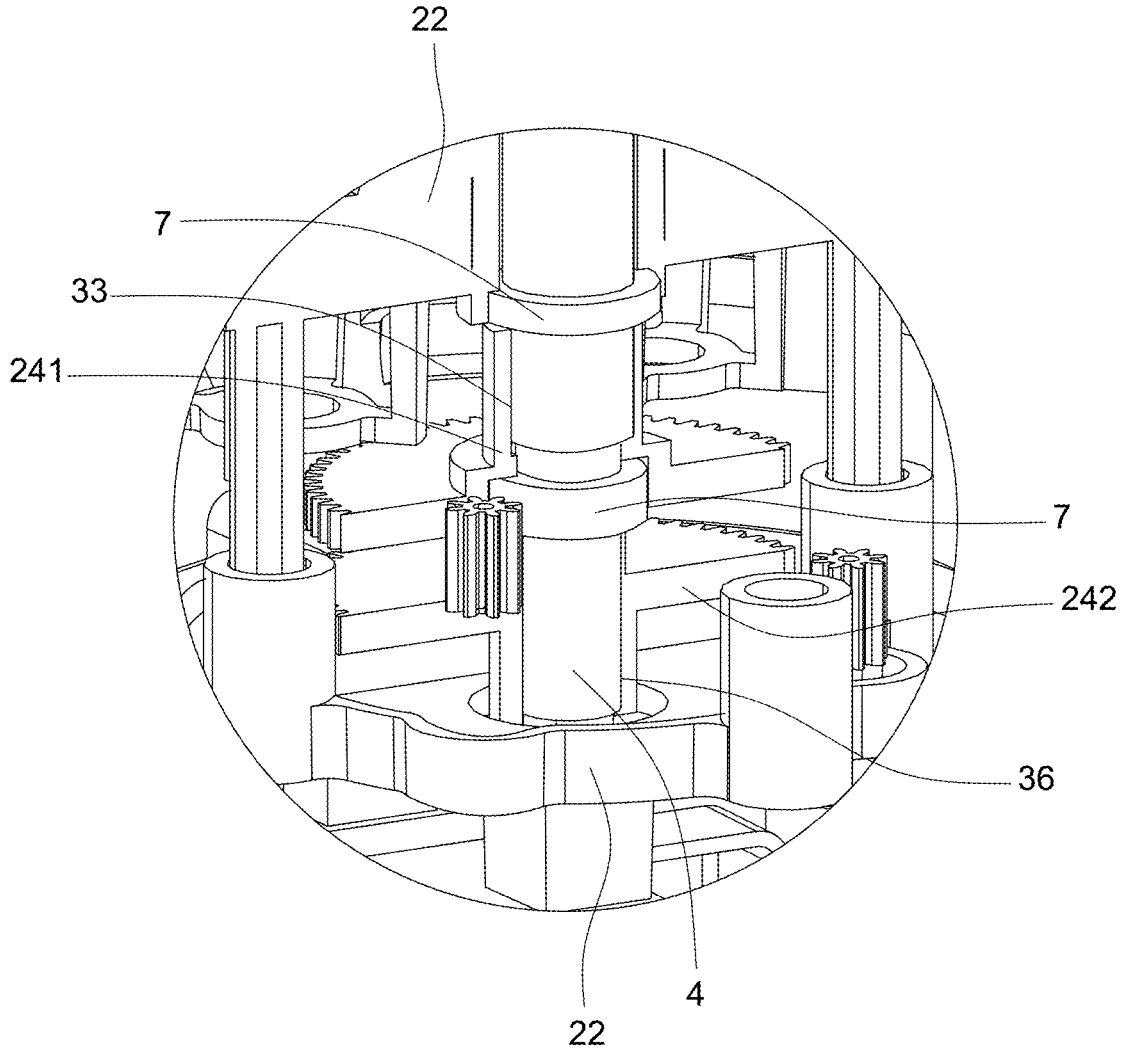
FIG. 11 is a partial enlarged view of a position G in FIG. 10 according to this disclosure.
Figure 12:
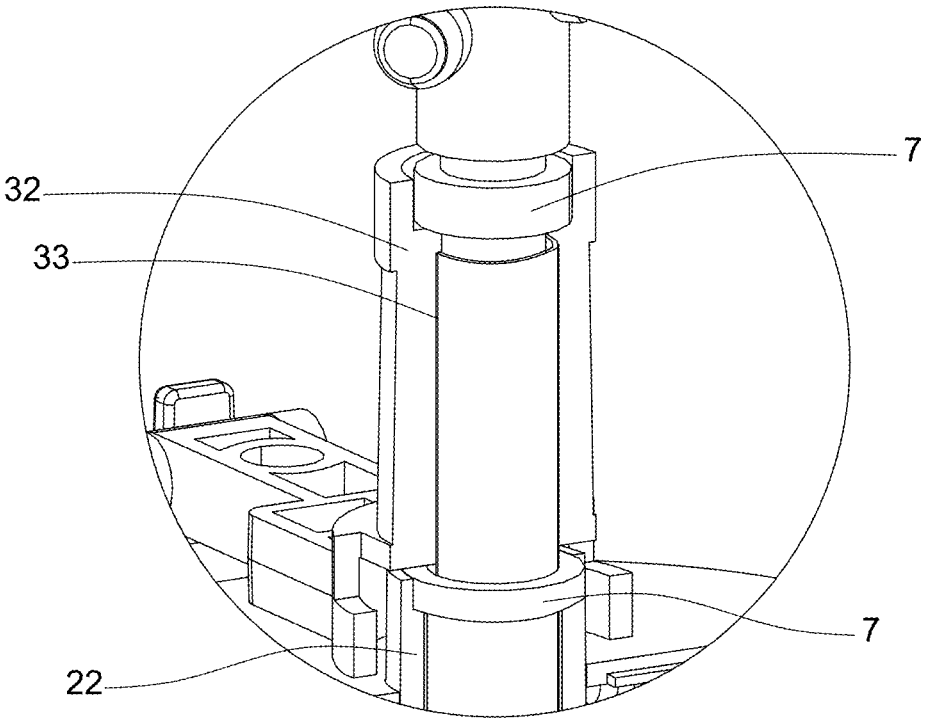
FIG. 12 is a partial enlarged view of a position H in FIG. 10 according to this disclosure.

As shown in FIG. 1 to FIG. 12, a toy aircraft includes a main body 1, a driving assembly 2, a lifting assembly 3, and a connecting rod 4; where the driving assembly 2 includes a battery box 21, a motor seat 22, a motor set 23, and a gear set 24, the battery box 21 and the motor seat 22 are both arranged in the main body 1, the motor set 23 is arranged on the motor seat 22, the gear set 24 is rotatably connected to the motor seat 22, the battery box 21 is electrically connected to the motor set 23, an output end of the motor set 23 is in meshing connection with the gear set 24, the connecting rod 4 extends into the main body 1 and is connected to the motor seat 22, and the gear set 24 is sleeved on the connecting rod 4; and the motor set 23 includes an outer motor 231 and an inner motor 232, the gear set 24 includes an outer gear 241 and an inner gear 242, the outer gear 241 and the inner gear 242 are coaxial and parallel to each other and are sleeved on the connecting rod 4 through a bearing 7, an output end of the outer motor 231 meshes with the outer gear 241, and an output end of the inner motor 232 meshes with the inner gear 242.

The lifting assembly 3 includes a first rotating blade 31, a first rotating shaft 32, a first rotating cylinder 33, a second rotating blade 34, a second rotating shaft 35, a second rotating cylinder 36, a balance shaft 37, a balance rod 38, and a stabilizing rod 39. The first rotating shaft 32 is sleeved on the connecting rod 4 and is connected to the gear set 24, and the first rotating blade 31 is rotatably connected to an outer side wall of the first rotating shaft 32; the first rotating cylinder 33 is sleeved on the connecting rod 4 and is connected to the motor seat 22 through a bearing 7, an upper end of the first rotating cylinder 33 is embedded and fixed in the first rotating shaft 32, and a lower end of the first rotating cylinder 33 is embedded and fixed in the outer gear 241; the second rotating shaft 35 is sleeved on the connecting rod 4, the second rotating blade 34 is rotatably connected to an outer side wall of the second rotating shaft 35, the second rotating cylinder 36 is sleeved on the connecting rod 4 and located in the first rotating cylinder 33, the second rotating cylinder 36 is connected to the first rotating shaft 32 and the outer gear 241 through a bearing 7, respectively, an upper end of the second rotating cylinder 36 is embedded and fixed in the second rotating shaft 35, and a lower end of the second rotating cylinder 36 is embedded and fixed in the inner gear 242; the balance shaft 37 is detachably connected to the second rotating shaft 35, the balance rod 38 is rotatably connected to an outer side wall of the balance shaft 37, and a counterweight block 381 is arranged at a tail end of the balance rod 38; and the stabilizing rod 39 is connected to the second rotating shaft 35 and the balance shaft 37, respectively.

The toy aircraft further includes a traveling assembly 5, where the traveling assembly 5 includes a fixed seat 51, a traveling motor 52, and a traveling rotating blade 53. The fixed seat 51 is arranged at a top end of the connecting rod 4, a transverse air duct 54 is arranged in the fixed seat 51, the traveling motor 52 is arranged in the fixed seat 51, an output end of the traveling motor 52 is connected to the traveling rotating blade 53, the traveling motor 52 is electrically connected to the battery box 21, and the traveling rotating blade 53 is vertically arranged in the transverse air duct 54.

Further, the main body 1 further includes a first surrounding wall 11 and a second surrounding wall 12. The first surrounding wall 11 is sleeved on and detachably connected to the first rotating shaft 32, the second surrounding wall 12 is sleeved on and detachably connected to the second rotating shaft 35, the first surrounding wall 11, the second surrounding wall 12, and the main body 1 are coaxial up and down and form a continuous cylindrical shell structure, and an outer portion of the fixed seat 51 is of a conc structure folded upwards.

Further, the toy aircraft further includes a spraying assembly 6, where the spraying assembly 6 includes a water tank 61 and an atomizer 62. The water tank 61 is arranged in the main body 1 and located at the bottom of the main body 1, a through hole for mounting the atomizer 62 is formed in a lower end surface of the water tank 61, and the bottom of the main body 1 is provided with a plurality of supporting legs 13 distributed circumferentially.

The working manner of this disclosure is described as follows:

according to the toy aircraft adopting the structure, the battery box 21 in the main body 1 supplies power to the motor set 23 on the motor seat 22, and a switch arranged on the main body 1 is used for opening and closing the battery box 21. Since the content belongs to the prior art, a redundant description of how to implement power supply will not be given here. The motor set 23 is detachably mounted on the motor seat 22. Preferably, the motor seat 22 is provided with a mounting seat for mounting the outer motor 231 and the inner motor 232. Both the outer motor 231 and the inner motor 232 are arranged vertically, and the outer gear 241 and the inner gear 242 are transversely arranged in parallel. The inner gear 242 is located below the outer gear 241 and is rotatably connected to the bottom of the motor seat 22, and the output ends of the outer motor 231 and the inner motor 232 are in meshing connection with the outer gear 241 and the inner gear 242, respectively.

To drive the first rotating blade 31 and the second rotating blade 34 to rotate in different directions in a starting process of the motor set 23, a connecting column is vertically arranged at the bottom of the motor seat 22 and extends upwards vertically, the first rotating cylinder 33 is sleeved on the connecting column and is connected to the motor seat 22 through a bearing 7, the upper end of the first rotating cylinder 33 is embedded and fixed in the first rotating shaft 32, and the lower end of the first rotating cylinder 33 is embedded and fixed in the outer gear 241. Therefore, in a process of starting the outer motor 231, the outer gear 241 meshed with the outer motor is driven to rotate, so that the first rotating shaft 32 is driven to rotate, the first rotating blade 31 rotatably connected to the outer side wall of the first rotating shaft 32 rotates, and at least two groups of first rotating blades 31 with the first rotating shaft 32 as a symmetric center rotate under the action of centrifugal force; and the second rotating cylinder 36 is also sleeved on the connecting column and located in the first rotating cylinder 33, the second rotating cylinder 36 is connected to the first rotating shaft 32 and the outer gear 241 through a bearing 7, respectively, the upper end of the second rotating cylinder 36 is embedded and fixed in the second rotating shaft 35, and the lower end of the second rotating cylinder 36 is embedded and fixed in the inner gear 242. Therefore, when the inner motor 232 is started and a rotation direction opposite to the outer motor 231 is kept, the inner gear 242 meshed with the inner motor is driven to rotate, so that the second rotating shaft 35 is driven to rotate, the second rotating blade 34 rotatably connected to the outer side wall of the second rotating shaft 35 rotates, at least two groups of second rotating blades 34 with the second rotating shaft 35 as a symmetric center rotate reversely under the action of centrifugal force, the effect of simultaneous reverse rotation of the double-layer rotating blades is achieved, the reverse torsion force caused by the double-layer rotating blades is counteracted, and stable up-down flight is achieved.

The lift-off effect caused by simple reverse rotation of the double-layer rotating blades is still unstable, and the reason lies in that the air under synchronous rotation is pressurized and turbulent, which causes the aircraft to swing left and right, and the flight state is unstable. Therefore, through at least two groups of balance rods 38 which are mounted on the second rotating shaft 35 and are symmetrical to each other, the balance rods 38 are synchronously driven to rotate in the rotating process of the second rotating blade 34, and the counterweight block 381 at the end portion of the balance rod 38 can effectively provide stronger centrifugal force, so that left-right transverse swing force caused by turbulence is counteracted, and stable up-down flight of the aircraft is ensured. The stabilizing rod 39 is arranged to fix the connection between the second rotating shaft and the balance shaft 37.

Since the lift-off effect of the double-layer rotating blades moves up and down, horizontal transverse movement cannot be achieved without external force. Thus, the fixed seat 51 is arranged at an upper end of the connecting rod 4, the traveling rotating blade 53 is vertically arranged on the transverse air duct 54 in the fixed seat 51, and the traveling rotating blade 53 is driven by the traveling motor 52, and therefore, when the aircraft is in a hovering state, the aircraft can be assisted in transverse displacement by starting the traveling rotating blade 53, thereby achieving the flight effect in each of the up-down, left-right, front-back directions.

Due to the flight effect of the aircraft moving up and down, left and right, and front and back, which is similar to a starship, the first surrounding wall 11 is arranged on the first rotating shaft 32, the second surrounding wall 12 is arranged on the second rotating shaft 35, the first surrounding wall 11, the second surrounding wall 12, and the main body 1 are coaxial up and down and form a continuous cylindrical shell structure, and an outer portion of the fixed seat 51 is of a cone structure folded upwards. Meanwhile, the supporting legs 13 are arranged at the bottom of the main body 1, so that the overall appearance is like a starship hovering during launch, which is more attractive to children to play with it.

Since the appearance has presented the effect of the starship, the absence of a flame-like jet effect during hovering will appear that the toy is not real enough. Therefore, a water tank 61 is arranged at the bottom of the main body 1. The bottom of the water tank 61 is sprayed by an atomizer 62, and when necessary, a bulb, preferably a red bulb, is added to the bottom of the water tank 61. When the atomizer 62 and the bulb are started, the double-layer rotating blades are started at the same time to assist the main body 1 to lift off, a simulation effect similar to starship launching can be achieved, making the toy more interesting. In addition, after completing hovering flight, the aircraft can perform in-place landing, and after landing, the first rotating blade 31, the second rotating blade 34, and the balance rod 38 on the aircraft are folded downwards under the action of gravity, without taking up space when not started.

Beneficial effects of this disclosure are as follows: the outer motor 231 and the inner motor 232 are mounted and the outer gear 241 and the inner gear 242 are driven, respectively, so that the effect of simultaneous reverse rotation of the double-layer rotating blades is achieved, the reverse torsion force caused by the double-layer rotating blades is counteracted, and stable up-down flight is achieved. To counteract the left-right transverse swing force caused by turbulence, and ensure stable up-down flight of the aircraft, a balance rod 38 synchronously rotating with the second rotating blade 34 is arranged, so that more stable up-down flight is achieved, meanwhile, transverse displacement of the aircraft is achieved through arrangement of the traveling rotating blade 53, and finally the flight effect in each of the up-down, left-right, front-back directions is achieved. Meanwhile, in cooperation with the atomizer 62 and the bulb, a simulation effect similar to starship launching can be achieved, making the toy more interesting.

The above embodiments are only used to illustrate the technical solutions of this disclosure rather than limiting thereto. Although this disclosure has been described in detail with reference to the above embodiments, those of ordinary skill in the art should understand that the technical solutions recited in the above embodiments may still be modified, or some or all of the technical features thereof may be replaced with equivalents. These modifications or replacements do not make the essence of the corresponding technical solution deviate from the scope of the technical solutions in the embodiments of this disclosure.

What is claimed is:

1. A toy aircraft, comprising a main body, a driving assembly, a lifting assembly, and a connecting rod; wherein the driving assembly comprises a battery box, a motor seat, a motor set, and a gear set, the battery box and the motor seat are both arranged in the main body, the motor set is arranged on the motor seat, the gear set is rotatably connected to the motor seat, the battery box is electrically connected to the motor set, an output end of the motor set is in meshing connection with the gear set, the connecting rod extends into the main body and is connected to the motor seat, and the gear set is sleeved on the connecting rod; and wherein the motor set comprises an outer motor and an inner motor, the gear set comprises an outer gear and an inner gear, the outer gear and the inner gear are coaxial and parallel to each other and are sleeved on the connecting rod through a bearing, an output end of the outer motor meshes with the outer gear, and an output end of the inner motor meshes with the inner gear; and the lifting assembly comprises a first rotating blade, a first rotating shaft, a first rotating cylinder, a second rotating blade, a second rotating shaft, and a second rotating cylinder, the first rotating shaft is sleeved on the connecting rod and is connected to the gear set, and the first rotating blade is rotatably connected to an outer side wall of the first rotating shaft; the first rotating cylinder is sleeved on the connecting rod and is connected to the motor seat through a bearing, an upper end of the first rotating cylinder is embedded and fixed in the first rotating shaft, and a lower end of the first rotating cylinder is embedded and fixed in the outer gear; the second rotating shaft is sleeved on the connecting rod, the second rotating blade is rotatably connected to an outer side wall of the second rotating shaft, the second rotating cylinder is sleeved on the connecting rod and located in the first rotating cylinder, the second rotating cylinder is connected to the first rotating shaft and the outer gear through a bearing, respectively, an upper end of the second rotating cylinder is embedded and fixed in the second rotating shaft, and a lower end of the second rotating cylinder is embedded and fixed in the inner gear.

2. The toy aircraft according to claim 1, wherein the lifting assembly further comprises a balance shaft and a balance rod, the balance shaft is detachably connected to the second rotating shaft, the balance rod is rotatably connected to an outer side wall of the balance shaft, and a counterweight block is arranged at a tail end of the balance rod.

3. The toy aircraft according to claim 2, wherein the lifting assembly further comprises a stabilizing rod, and the stabilizing rod is connected to the second rotating shaft and the balance shaft, respectively.

4. The toy aircraft according to claim 3, further comprising a traveling assembly, wherein the traveling assembly comprises a fixed seat, a traveling motor, and a traveling rotating blade, the fixed seat is arranged at a top end of the connecting rod, a transverse air duct is arranged in the fixed seat, the traveling motor is arranged in the fixed seat, an output end of the traveling motor is connected to the traveling rotating blade, the traveling motor is electrically connected to the battery box, and the traveling rotating blade is vertically arranged in the transverse air duct.

5. The toy aircraft according to claim 4, wherein the main body further comprises a first surrounding wall and a second surrounding wall, the first surrounding wall is sleeved on and detachably connected to the first rotating shaft, the second surrounding wall is sleeved on and detachably connected to the second rotating shaft, the first surrounding wall, the second surrounding wall, and the main body are coaxial up and down and form a continuous cylindrical shell structure, and an outer portion of the fixed seat is of a conical structure.

6. The toy aircraft according to claim 5, further comprising a spraying assembly, wherein the spraying assembly comprises a water tank and an atomizer, the water tank is arranged in the main body and located at the bottom of the main body, and a through hole for mounting the atomizer is formed in a lower end surface of the water tank.

7. The toy aircraft according to claim 6, wherein the bottom of the main body is provided with a plurality of supporting legs distributed circumferentially.

* * * * *